US008681069B2

(12) United States Patent
Kaneko et al.

(10) Patent No.: US 8,681,069 B2
(45) Date of Patent: Mar. 25, 2014

(54) SUBSTRATE TYPE ANTENNA

(75) Inventors: Tutomu Kaneko, Tokyo (JP); Takahisa Karakama, Nakano (JP)

(73) Assignees: NISSEI Limited, Tokyo (JP); Faverights, Inc., Nakano-shi (JP)

( * ) Notice: Subject to any disclaimer, the term of this patent is extended or adjusted under 35 U.S.C. 154(b) by 161 days.

(21) Appl. No.: 13/427,623

(22) Filed: Mar. 22, 2012

(65) Prior Publication Data

US 2012/0242559 A1 Sep. 27, 2012

(30) Foreign Application Priority Data

Mar. 23, 2011 (JP) ..... 2011-064052

(51) Int. Cl.
*H01Q 1/38* (2006.01)

(52) U.S. Cl.
USPC ..... 343/853; 343/700 MS

(58) Field of Classification Search
USPC ..... 343/700 MS, 850, 853
See application file for complete search history.

(56) References Cited

U.S. PATENT DOCUMENTS 7,265,720 B1 * 9/2007 Ponce De Leon et al. .... 343/700 MS
2005/0248488 A1 * 11/2005 Modro ..... 343/700 MS
2007/0229368 A1 * 10/2007 Hata et al. ..... 343/700 MS

FOREIGN PATENT DOCUMENTS

JP 2007-142666 A 6/2007

* cited by examiner

*Primary Examiner* — Hoanganh Le
(74) *Attorney, Agent, or Firm* — Crowell & Moring LLP

(57) ABSTRACT

The present invention provides a substrate type antenna having resonant frequencies different in a simple configuration. At least one loop-like another joint pattern one spot of which is divided is formed at a position opposite to a second joint pattern having common feeding points. Antennas are respectively connected to both end terminals of both of a first joint pattern and another joint pattern referred to above at their divided positions. The antennas connected to the first joint pattern and the antennas connected to another joint pattern referred to above are respectively made different in resonant frequency.

3 Claims, 4 Drawing Sheets

SUBSTRATE TYPE ANTENNA

CLAIM OF PRIORITY

The present application claims priority from Japan patent application JP 2011-064052 filed on Mar. 23, 2011, the content of which is hereby incorporated by reference in this application.

BACKGROUND OF THE INVENTION

1. Field of the Invention

The present invention relates to a substrate type antenna configured on a thin substrate.

2. Description of the Related Art

As this type of substrate type antenna of related art, there has been known a configuration which has a substrate made of a dielectric material, a loop-like first coupled-portion or joint pattern formed in a first substrate surface of the substrate and divided at one spot thereof, and a loop-like second coupled-portion or joint pattern formed in a second substrate surface of the substrate and divided at one spot thereof, and in which electrostatic capacitively-coupled and magnetic inductively-coupled states are formed between the first joint pattern and the second joint pattern (refer to, for example, Patent Document 1 (Japanese Patent Application Laid-Open No. 2007-142666)). According to such a configuration, unlike a conventional case in which patterns are formed on the same plane, the electrostatic capacitively-coupled and magnetic inductively-coupled states between the patterns based on the substrate are greatly improved, and a high-frequency coupler excellent in characteristic as compared with the related art can easily be obtained.

Since the substrate type antenna of the related art was however based only on the concept of an antenna having one resonant frequency, it was not able to take full advantage of the effect of using a thin substrate.

SUMMARY OF THE INVENTION

An object of the present invention is to provide a substrate type antenna having different resonant frequencies in a simple configuration.

In order to achieve the above object, the present invention provides a substrate type antenna that includes a loop-like first joint pattern one spot of which is divided, which is formed in one substrate surface of a substrate comprised of a dielectric material; antennas respectively connected to both end terminals of the first joint pattern at a position where the first joint pattern is divided; a loop-like second joint pattern formed in the other substrate surface of the substrate, which has feeding points and which is formed at a position opposite to the first joint pattern and one spot of which is divided; at least one loop-like another joint pattern one spot of which is divided, which is formed at a position opposite to the second joint pattern; and other antennas respectively connected to both end terminals of another joint pattern referred to above at a position where another joint pattern referred to above is divided, wherein the antennas connected to the first joint pattern and the other antennas connected to another joint pattern referred to above are made different in resonant frequency.

According to such a configuration, a plurality of antennas different in resonant frequency, which have shared feeding points, can be configured while the above antenna is of a substrate type antenna which is simple and thin apparently. Despite the presence of plural couplings, the gain of combination of both the gain of the antennas themselves connected to at least the first joint pattern, and the gain of the antennas alone connected to another joint pattern can be taken out from the shared feeding points.

According to the present invention as well, in addition to the above configuration, the joint pattern for either one high in resonant frequency, of the antennas connected to the first joint pattern, and the other antennas connected to another joint pattern referred to above is made smaller in opposite area than the joint pattern for the other thereof low in resonant frequency.

According to such a configuration, even if a plurality of antennas different in resonance frequency are provided, a substrate type antenna good in characteristic can be realized in a simple configuration even on the side of a high resonant frequency.

Further, according to the present invention, in addition to the above configuration, at least one another joint pattern referred to above is formed concentrically with the first joint pattern formed in the one substrate surface.

According to such a configuration, a plurality of joint patterns are concentrically coupled to one another so that a plurality of resonant frequencies can be taken out from common feeding points while the configuration of a substrate is being simplified extremely.

According to the substrate type antenna according to the present invention, a plurality of antennas different in resonant frequency, which have shared feeding points thereamong, can be configured while the antenna is of a substrate type antenna which is simple and thin apparently. Despite the existence of plural couplings, the gain of combination of both the gain of the antennas themselves connected to at least a first joint pattern, and the gain of the antennas alone connected to another joint pattern can be taken out from the shared feeding points.

Other features and advantages of the present invention will become apparent upon a reading of the attached specification.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENTS

Preferred embodiments of the present invention will be explained hereinafter with reference to the accompanying drawings.

Figure 1:
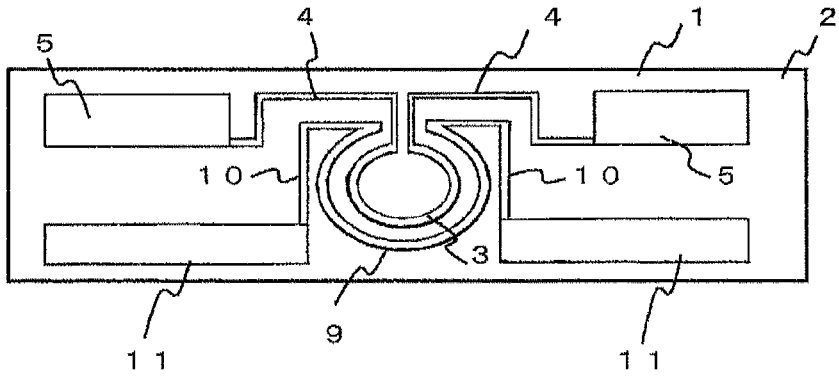
FIG. 1 is a plan view showing one substrate surface of a substrate type antenna according to one embodiment of the present invention.
Figure 2:
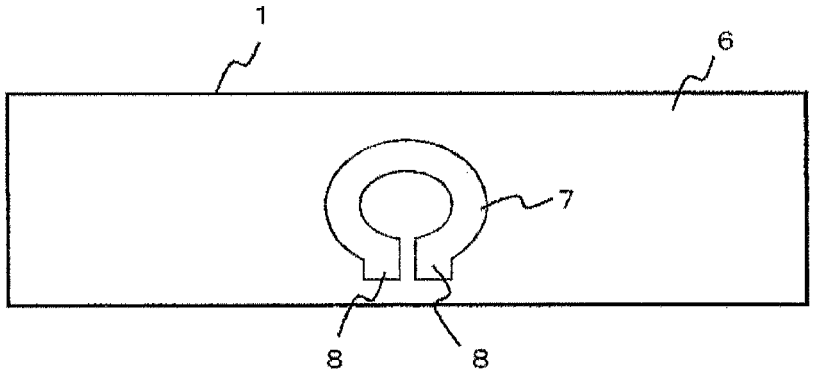
FIG. 2 is a plan view illustrating a backside substrate surface of the substrate type antenna shown in FIG. 1.

FIGS. 1 and 2 are plan views respectively showing a topside substrate surface and a backside substrate surface of a substrate type antenna according to one embodiment of the present invention. A loop-like first joint pattern 3 one spot of which being divided as shown in FIG. 1, is formed in a topside substrate surface 2 of a substrate 1 comprised of a dielectric material. Antennas 5 like dipoles are respectively connected via electric paths 4 to both end terminals of the first joint pattern 3 at a position where the first joint pattern 3 is divided. The first joint pattern 3 is formed so as to be opposite to a second joint pattern 7 formed in a n backside substrate surface 6 as will be described in detail later.

At the topside substrate surface 2 of the same substrate 1, antennas 11 like second dipoles are respectively connected via electronic paths 10 to a loop-like third joint pattern 9 one spot of which being divided substantially concentrically with the first joint pattern 3 and with its divided position being substantially matched with the first joint pattern 3, and both end terminals of the third joint pattern 9 at the divided position thereof. The third joint pattern 9 is also formed so as to be opposite to the second joint pattern 7 formed in the backside substrate surface 6 as will be described in detail later.

On the other hand, as shown in FIG. 2, the loop-like second joint pattern 7 one spot of which being divided is formed in the backside substrate surface 6 of the substrate 1. Common feeding points 8 are formed at their corresponding divided ends of the second joint pattern 7. Here, the second joint pattern 7 formed on the side of the backside substrate surface 6 is formed wider than the first joint pattern 3 and the third joint pattern 9 formed in the topside substrate surface 2.

The illustrated shapes of joint patterns 3, 7 and 9 are annular, but various shapes such as an ellipsoid, a polygon, their combinations, etc. can be adopted other than it. The shapes thereof may differ more or less in the topside substrate surface 2 of the substrate 1 and the backside substrate surface 6 thereof. Further, the substrate 1 is configured as a flat substrate constant in thickness, but is not limited to it.

Thus, the first joint pattern 3 formed in the topside substrate surface 2 of the substrate 1 shown in FIG. 1, and the second joint pattern 7 formed in the backside substrate surface 6 of the substrate 1 shown in FIG. 2 are disposed opposite to each other. The second joint pattern 7 that shares the use of the feeding points 8, and the third joint pattern 9 formed in the topside substrate surface 2 of the substrate 1 shown in FIG. 1 are placed in an opposing relationship, whereby an electrostatic capacitive coupling and a magnetic inductive coupling are formed at their opposite portions. The combined gain of both antennas 5 and 11 can be taken out from the common feeding points 8 even though these plural couplings exist.

In such a configuration, the resonant frequency of each of the antennas 5 and the resonant frequency of each of the antennas 11 are made different from each other without keeping them identical to each other. A description will now be made of where, for example, the resonant frequency of the antenna 5 is taken as a low frequency of 800 MHz and the resonant frequency of the antenna 11 is taken as a high frequency of 2 GHz. Thus, when the antennas 11 each having the high resonant frequency and the antennas 5 each having the low resonant frequency are coupled to each other by the common second joint pattern 7, the area of coupling between the common second joint pattern 7 and the first joint pattern 3 is increased at the low resonant frequency. To this end, the second joint pattern 7 and the first joint pattern 3 are disposed opposite to each other as seen in the vertical direction. For example, they are disposed opposite to each other in such a manner that the inner edge of the first joint pattern 3 is matched with the inner edge of the wide second joint pattern 7.

On the other hand, since the coupling area is reduced at the high resonant frequency as compared with the low resonant frequency, the outer edge of the third joint pattern 9 is brought to such a form as to match with the outer edge of the wide second joint pattern 7, for example.

Thus, if the first joint pattern 3 and the third joint pattern 9 are formed concentrically, the first joint pattern 3 placed thereinside is set for the low resonant frequency, and the third joint pattern 9 placed thereoutside is set for the high resonant frequency, then the first joint pattern 3 is still opposed to the second joint pattern 7 due to its wide range where both joint patterns 3 and 9 are disposed with a slight shift from the wide second joint pattern 7. On the other hand, since the third joint pattern 9 is located outside, part of the portion opposite to the second joint pattern 7 deviates, so that the coupling area can easily be reduced.

Figure 3:
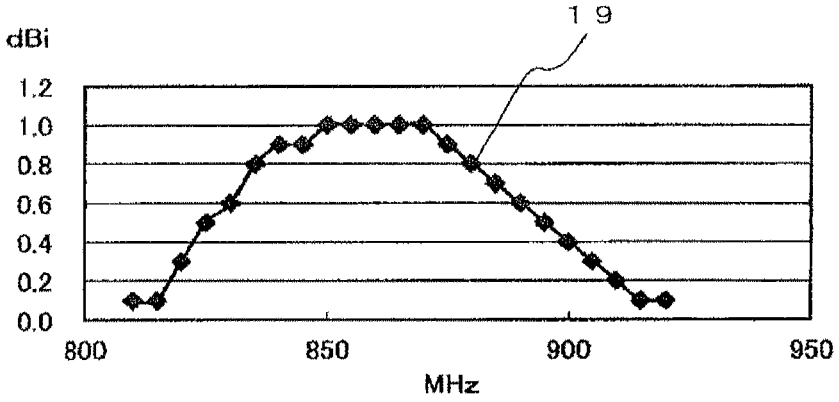
FIG. 3 is a gain characteristic diagram of one set of antennas shown in FIG. 1.
Figure 4:
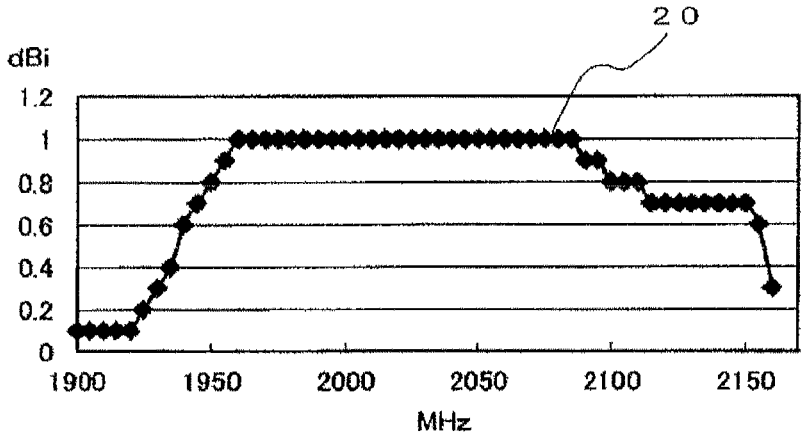
FIG. 4 is a gain characteristic diagram of another set of antennas shown in FIG. 1.

When the resonant frequency of each of the antennas 5 is designed to take 800 MHz, the gain of the antennas 5 themselves is brought to such a frequency gain characteristic curve 19 as shown in FIG. 3. When the resonant frequency of each of the antennas 11 is designed to take 2 GHz, the gain of the antennas 11 alone is brought to such a frequency gain characteristic curve 20 as shown in FIG. 4. When, however, the sizes and the like of the respective joint patterns are designed in such a manner that the gains of both antennas 5 and 11 are respectively received at a characteristic impedance of 50Ω from the feeding points 8 of the second joint pattern 7, the gain of the antennas 5 alone and the gain of the antennas 11 alone are combined together, so that such combined gain as indicated by a frequency combined gain characteristic curve 21 shown in FIG. 5 can be received from the feeding points 8.

That is, although the present antenna is of a sheet of thin substrate type antenna simple apparently, the two pairs of antennas 5 and 11 different in resonant frequency, which share the feeding points 8, can be configured. As is understand from FIG. 5, the frequency combined gain characteristic curve 21 in which the gain's peaks indicate an 800 MHz band and a 2 GHz band respectively can be obtained from the feeding points 8.

Thus, according to the substrate type antenna, the two pairs of antennas different in resonant frequency, which shares the feeding points, can be configured while making full use of the characteristics in which they are configured on the thin substrate. Despite the presence of the plural couplings, the gain made by combining the gain of the antennas 5 themselves connected to the first joint pattern 3 and the gain of the antennas 11 alone connected to the third joint pattern 9 can be obtained from the shared feeding points.

Since the first joint pattern 3 and the third joint pattern 9 are concentrically formed in the topside substrate surface 2 of the substrate 1 upon obtaining a plurality of resonant frequencies, the resonant frequencies can be obtained from the feeding points 8 in a simple configuration without complicating the configuration of the substrate 1.

Figure 6:
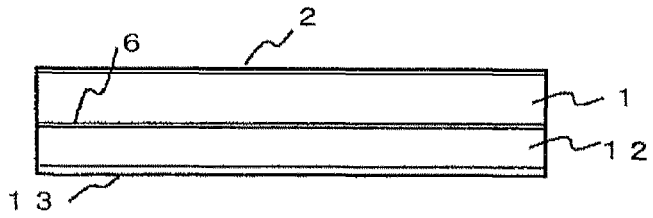
FIG. 6 is a side view of a substrate type antenna according to another embodiment of the present invention.
Figure 7:
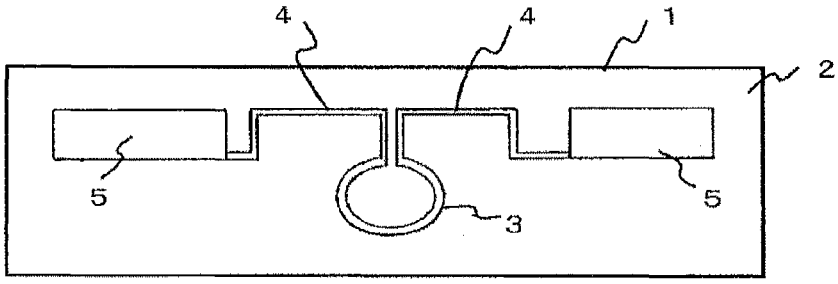
FIG. 7 is a plan view showing a topside substrate surface of one substrate of the substrate type antenna shown in FIG. 6.
Figure 8:
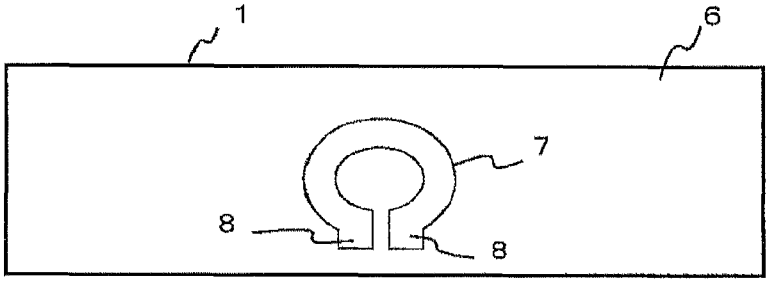
FIG. 8 is a bottom view illustrating a backside substrate surface of the substrate shown in FIG. 7.

FIGS. 6 through 9 are respectively side views showing a substrate type antenna according to another embodiment of the present invention. In the present embodiment, as shown in FIG. 6 being the side view, two sheets of substrates 1 and 12 each comprised of a thin type dielectric material are used and stacked on each other, followed by integration by means of an adhesive or other means. As shown in FIG. 7 corresponding to the plan view, a loop-like first joint pattern 3 is formed in a topside substrate surface 2 of the first sheet of substrate 1. Antennas 5 like dipoles are connected via electric paths 4 to both end terminals of the first joint pattern 3 at a position where the first joint pattern 3 is divided. As shown in FIG. 8, a loop-like second joint pattern 7 and feeding points 8 are formed in a backside substrate surface 6 of the substrate 1 at a position where they are located opposite to the loop-like first joint pattern 3 shown in FIG. 7.

Figure 9:
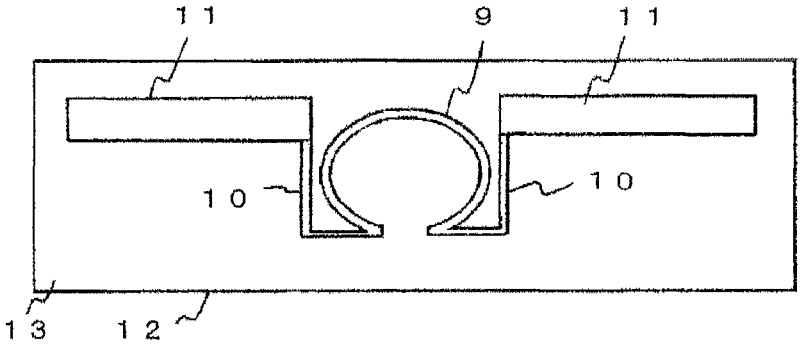
FIG. 9 is a bottom view showing a backside substrate surface of another substrate of the substrate type antenna shown in FIG. 6.

On the other hand, while joint patterns are not formed in a topside substrate surface of the second sheet of substrate 12, a loop-like third joint pattern 9 is formed in a backside substrate surface 13 thereof as shown in FIG. 9 corresponding to the plan view, and antennas 11 like dipoles are respectively connected via electric paths 10 to both end terminals of the third joint pattern 9 at a position where it is divided. The third joint pattern 9 is also formed at a position where it is opposite to the second joint pattern 7 shown in FIG. 8.

Even in such a substrate type antenna, the first joint pattern 3 formed in the topside substrate surface 2 of the substrate 1 shown in FIG. 7, and the second joint pattern 7 formed in the backside substrate surface 6 of the substrate 1 shown in FIG. 8 are disposed opposite to each other. The same second joint pattern 7 that shares the feeding points 8, and the third joint pattern 9 formed in the backside substrate surface 13 of the substrate 12 shown in FIG. 9 are disposed opposite to each other, whereby an electrostatic capacitive coupling and a magnetic inductive coupling are formed at their opposite portions.

Thus, in a manner similar to the previous embodiment, the combined gain of both antennas 5 and 11 can be taken out from the shared feeding points 8 while forming the plural joints despite the combination of the thin substrates 1 and 12.

Figure 5:
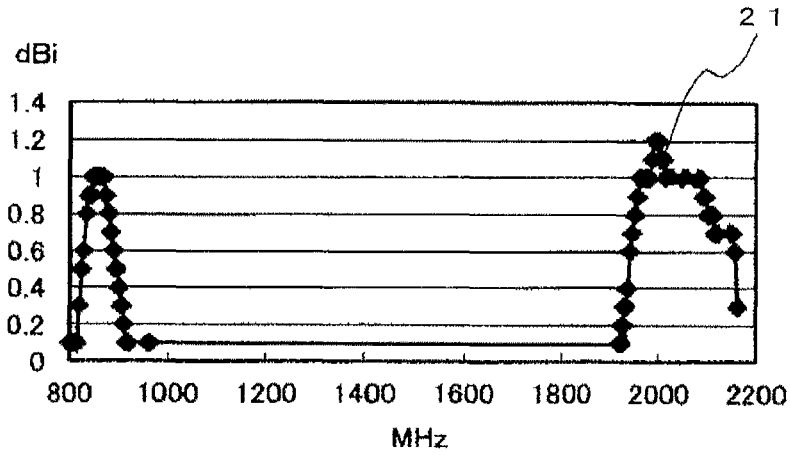
FIG. 5 is a combined gain characteristic diagram of the antennas shown in FIGS. 3 and 4.

When, for example, each of the antennas 5 is designed to have 800 MHz as its resonant frequency, each of the antennas 11 is designed to have 2 GHz as its resonant frequency, and the sizes and the like of the joint patterns are designed in such a manner that the gains of both antennas 5 and 11 are received at a characteristic impedance of 50Ω from the feeding points 8 of the second joint pattern 7, the gain of the antennas 5 alone and the gain of the antennas 11 alone are combined together so that the frequency combined gain characteristic curve 21 shown in FIG. 5 can be obtained.

Although the two sheets of substrates 1 and 12 are used even in the present embodiment, the two pairs of antennas 5 and 11 different in resonant frequency, which share the feeding points 8, can be configured while both substrates are stacked on each other and connected to each other by making use of the characteristics of the thin substrates and allowed to function as a sheet of thin substrate type antenna apparently. The combined gain in which the peaks of such gains as shown in FIG. 5 differ can be obtained in a manner similar to the previous embodiment, for example.

Incidentally, although the resonant frequency of the pair of antennas 5 and the resonant frequency of the pair of antennas 11 have been described as 800 MHz and 2 GHz respectively, the present invention is not limited to it. They may be configured as other combinations different in resonant frequency. Although the above-described embodiment has explained the case where the two resonant frequency bands are taken out from the common feeding points 8, the present invention is not limited to it. The feeding points are used in common so that a larger number of resonant frequency bands can be taken out. If, for example, the above configuration is replaced with the configuration of the dual joint patterns 3 and 9 and antennas 5 and 11 shown in FIG. 1 in the topside substrate surface 2 shown in FIG. 7, resonant frequency bands three in total can be taken out. If the configurations of the topside and backside substrate surfaces 2 and 13 shown in FIGS. 7 and 9 are both replaced with the configuration of the dual joint patterns 3 and 9 and antennas 5 and 11 shown in FIG. 1, different resonant frequency bands four in total can be taken out. Further, if the joint patterns formed concentrically are set not only to the dual configuration but also to a triple configuration, many more resonant frequencies can also be taken out.

In any of these cases, a plurality of joint patterns are concentrically formed in one substrate surface of a thin substrate when a plurality of resonant frequencies are obtained, thereby making it possible to obtain the resonant frequencies from the common feeding points 8 in a simple configuration without complicating the configuration of the substrate.

While the preferred forms of the present invention have been described, it is to be understood that modifications will be apparent to those skilled in the art without departing from the spirit of the invention. The scope of the invention is to be determined solely by the following claims.

FIG. 1

1: CIRCUIT SUBSTRATE, 2: TOPSIDE SUBSTRATE SURFACE, 3: JOINT PATTERN, 4: ELECTRIC PATH, 5: ANTENNA, 9: JOINT PATTERN, 10: ELECTRIC PATH, 11: ANTENNA.

What is claimed is:

1. A substrate type antenna comprising:

a loop-like first joint pattern one spot of which is divided, said first joint pattern being formed in one substrate surface of a substrate comprised of a dielectric material;

antennas respectively connected to both end terminals of the first joint pattern at a position where the first joint pattern is divided;

a loop-like second joint pattern which is formed at a position opposite to the first joint pattern and has feeding points, and one spot of which is divided, said second joint pattern being formed in a backside substrate surface of the substrate;

at least another loop-like joint pattern one spot of which is divided, said loop-like joint pattern being formed at a position opposite to the second joint pattern; and other antennas respectively connected to both end terminals of said another joint pattern at a position where said another joint pattern is divided, wherein the antennas connected to the first joint pattern and said other antennas connected to said another joint pattern are made different in resonant frequency.

2. The substrate type antenna according to claim 1, wherein the joint pattern for either one high in resonant frequency, of the antennas connected to the first joint pattern, and the other antennas connected to said another joint patterns is made smaller in opposite area than the joint pattern for the other thereof low in resonant frequency.

3. The substrate type antenna according to claim 1, wherein at least one said another joint pattern is formed concentrically with the first joint pattern formed in said one substrate surface.

* * * * *